US011661799B2

(12) United States Patent
Davila et al.

(10) Patent No.: US 11,661,799 B2
(45) Date of Patent: May 30, 2023

(54) SHAPED CUTTER WITH ALIGNMENT STRUCTURE FOR DRILL BIT AND ASSEMBLY METHOD THEREOF

(71) Applicant: CNPC USA CORPORATION, Houston, TX (US)

(72) Inventors: Javier Davila, Houston, TX (US); Chris X. Cheng, Houston, TX (US)

(73) Assignee: CNPC USA CORPORATION, Houston, TX (US)

( * ) Notice: Subject to any disclaimer, the term of this patent is extended or adjusted under 35 U.S.C. 154(b) by 15 days.

(21) Appl. No.: 17/247,474

(22) Filed: Dec. 11, 2020

(65) Prior Publication Data

US 2021/0180409 A1 Jun. 17, 2021

Related U.S. Application Data

(60) Provisional application No. 62/947,415, filed on Dec. 12, 2019.

(51) Int. Cl.

| | |
|---|---|
| ***E21B 10/43*** | (2006.01) |
| ***E21B 10/573*** | (2006.01) |
| ***E21B 10/55*** | (2006.01) |

(52) U.S. Cl.
CPC ..... *E21B 10/5735* (2013.01); *E21B 10/55* (2013.01)

(58) Field of Classification Search
CPC ..... E21B 10/5673; E21B 10/55; E21B 10/43
See application file for complete search history.

(56) References Cited

U.S. PATENT DOCUMENTS

| | | | | |
|---|---|---|---|---|
| 5,605,198 | A * | 2/1997 | Tibbitts | E21B 10/43 175/432 |
| 10,107,043 | B1 * | 10/2018 | Chapman | F16C 33/26 |
| 2018/0355672 | A1 * | 12/2018 | De Maindreville | E21B 10/42 |

* cited by examiner

*Primary Examiner* — D. Andrews
*Assistant Examiner* — Ronald R Runyan
(74) *Attorney, Agent, or Firm* — Ramey LLP; Jacob B. Henry; Jim Xiao

(57) ABSTRACT

Disclosed is a drill bit for cutting formation comprises a bit body, a plurality of cutters, a plurality of blades with pockets to accommodate the cutters respectively. Each of the plurality of cutters has at least one alignment structure to align with at least one counter-alignment structure on each of the pockets to locate the rotary orientation between each of the plurality of cutters and each of the corresponding pockets.

17 Claims, 9 Drawing Sheets

Prior art

Prior art

Prior art

Prior art

SHAPED CUTTER WITH ALIGNMENT STRUCTURE FOR DRILL BIT AND ASSEMBLY METHOD THEREOF

CROSS-REFERENCE TO RELATED APPLICATIONS

This application claims the benefit of U.S. Provisional Application No. 62/947,415, filed Dec. 12, 2019; hereby incorporated by reference in its entirety.

FIELD

The disclosure relates generally to drill bits in the oil and gas industry. The disclosure relates specifically to bits having shaped cutting elements configured to enhance cutter life and performance, including method therefore.

BACKGROUND

In drilling a borehole in the earth, such as for the recovery of hydrocarbons or for other applications, it is conventional practice to connect a drill bit on the lower end of a drill string. The bit is rotated by rotating the drill string at the surface or by actuation of downhole motors or turbines, or by both methods. The drill bit is rotated and advanced into the subterranean formation. As the drill bit rotates, the cutters or abrasive structures thereof cut, crush, shear, and/or abrade away the formation material to form the borehole. Different types of rotary drill bits are known in the art including, for example, fixed cutter bits (which are often referred to in the art as "drag" bits), rolling-cutter bits (which are often referred to in the art as "rock" bits), diamond-impregnated bits, and hybrid bits (which may include, for example, both fixed cutter sand rolling cutters).

Drag bits have no moving elements, and include bits that have cutting structures, referred to as "cutters", "cutting elements" or "inserts", attached to the bit body, which may be a steel bit body or a matrix bit body formed from a matrix material such as tungsten carbide surrounded by a binder material. A drag bit can provide an improved rate of penetration (ROP) over a rolling-cutter bit in many formations. The cutting element typically includes a substrate or support stud made of cemented carbide, for example tungsten carbide, and an ultra-hard cutting surface layer or "table" made of a polycrystalline diamond material (PCD) or a polycrystal line boron nitride material deposited onto or otherwise bonded to the substrate at an interface surface.

Referring to FIG. 1, a conventional drag bit adapted for drilling through formations of rock to form a borehole is shown. The drag bit includes a drill bit body 3 and a plurality of blades 4 and a connection or pin 32 for connecting the bit to a drill string (not shown) which is employed to rotate the bit to drill the borehole. The blades 4 are separated by channels or gaps that enable drilling fluid to flow between and both clean and cool the blades 4 and cutters 5. Cutters 5 are held in the blades 4 at predetermined angular orientations and radial locations to present working surface 503 with a desired back rake angle against a formation to be drilled. that means each cutter has a unique radial position with respect to the longitudinal bit axis 6. A fluid channel 31 is formed in the drill bit body 3 and a plurality fluid holes 33 communicate with the fluid channel. Fluid can be pumped to discharge drilling fluid in selected directions and at selected rates of flow between the cutting blades 4 for lubricating and cooling the drill bit, the blades 4 and the cutters 5. The drilling fluid also cleans and removes the cuttings as the drill bit rotates and penetrates the formation.

The drill bit body 3 is substantially cylindrical, the plurality of the cutters 5 are disposed on the outer edge of the blade 4, furthermore, the outer edge of the blade 4 comprises a heart portion 431, a nose portion 432, a shoulder portion 433 and a gauge protection portion 434 connected in turn which are extended from the center shaft diameter of the drill bit body 3 to outside, the heart portion 431 is close to the central axis of the drill bit body 3, the gauge protection portion 434 is located on the side wall of the drill bit body 3 and the cutters 5 are distributed across the heart portion 431, the nose portion 432, the shoulder portion 433 and the gauge protection portion 434 of the blade 4.

Referring to FIG. 2, a conventional cutter 5 is substantially cylindrical, includes a PCD table 502 and a cemented carbide substrate 504. The PCD table 502 includes an upper exterior working surface 503 and may include an optional chamfer 507 formed between the working surface 503 and the substrate 504. It is noted that at least a portion of the chamfer 507 may also function as a working surface that contacts a subterranean formation during drilling operations. Typically, the working surface 503 is generally perpendicular to the side surface of cemented carbide substrate 504. The flat top cutting elements as shown in FIG. 2 are generally the most common and convenient to manufacture with an ultra-hard layer according to known techniques.

Referring to FIG. 3, the conventional cutter 5 cuts the formation 410 with planar cutting edge. In the drilling process, the drill bit (see FIG. 1) will be rotated for cutting the inside surface of a cylindrical well bore. the PCD table 502 cuts rock and withstands great impact from the rock at the same time. A back rake angle $\alpha$ is used to describe the working angle of the working surface 503, the back rake angle $\alpha$ defined as the angle subtended between the working surface 503 and a line 514 perpendicular to the surface of the formation 410. The back rake angle $\alpha$ corresponds to the magnitude of the attack angle $\beta$ between the working surface 503 and an imaginary tangent line at the point of contact with the well bore. It will be appreciated that the point of contact is actually an edge or region of the well bore. Typically, the geometry of the cutter 5 relative to the well bore is described in terms of the back rake angle $\alpha$.

Back rake angle has a major effect on the way in which a bit interacts with a formation. It is a key factor in defining the aggressiveness or depth of cut by a cutter. Aggressiveness is increased by decreasing back-rake angle. This increases depth of cut and results in increased ROP. Smaller back-rake angles are thus used to maximize ROP when softer formations are drilled. Increased back-rake angles reduce depth of cut and, thus, ROP and bit vibration. It increases cutter life. An increase in angle also reduces cutter breakage from impact loading when harder formations are encountered. Harder formations require greater back rake angles to give durability to the cutting structure and reduce "chatter" or vibration. Individual cutters normally have different back-rake angles that vary with their position between the bit center and gauge. For example, cutters that are located within about a third of the bit radius from the bit's longitudinal axis 6 are typically oriented with nominal 15° back rake angles. Cutters located in the shoulder area of the bit are oriented with back rake angles of about 20°. Cutters that are positioned near the gage section of the bit are typically oriented so as to have even higher back rake angles, for instance, about 30°.

Since the working surface of the PCD table 502 lacks the flexibility of reduced contact area, it is prone to impact damage when drilling into a high gravel content formation or a hard formation, resulting in damage to the cutting faces. On the other hand, when drilling in shale, mudstone and other formations, the debris produced by cutting through diamond composite sheet can easily form a long strip shape debris 413. Due to the large size of this kind of debris, it will easily attach to the blades 4 and body part of the bit to form balling, such that the cutting work faces of the blades of the bit are wrapped and unable to continue working, eventually leading to decrease of mechanical speed, no drill footage and other issues.

Referring back to FIG. 3, the working surface 503 is plane and the size and the angle of chamfer 507 are constant circumferentially around the cutting edge such that the cutter 5 is axially symmetrical. While an axially symmetrical shape can provide some additional strength and support to the contact edge at some cutting depth, the cutting efficiency of these cutters may be reduced. Also, with the axially symmetrical shape, the amount of support to the ultra-hard layer and the strength of the edge is substantially the same at all depths of cut. Further, the average back rake angle of such cutters does not change significantly with changing depth of cut. It has been found by that increased strength due to a constant size chamfer and axially symmetrical shape does not necessarily counteract the extra proportional increase of loading associated with changes in cutting depth when using cylindrically shaped cutters. This can result in a corresponding increase in cracking, crack propagation, chipping and spalling.

Shaped cutters which have concave, convex or other non-flat working surfaces are developed in recent years to significantly improve the performance of the bit such as the rate of penetration and cutter wear. For example, U.S. Pat. No. 5,332,051 to Knowlton discloses a cutter having convex surface to provide optimum rock shearing ability with a positive and negative side rake angle to deflect detritus from the curved face. U.S. Pat. No. 7,726,420 to Yuelin Shen et al. describe a cutter having shaped working structure with varying edge chamfer that can better withstand high loading at critical region imposed during drilling so as to have an enhanced operating life. U.S. Pat. No. 8,327,955 to Patel teaches a cutter having a cutting face in non-perpendicular orientation with respect to a longitudinal axis of the cutter such that the cutter has the ability to be installed having a desired rake angle. It may be installed essentially any desired cutter location on a drill bit merely by changing the orientation of the cutting face when the cutter is installed on the drill bit. All the shaped cutters in these patents are incorporated herein by reference.

An example of a prior art shaped cutter is shown in FIG. 4, a cutter 160 has a harder layer 168 bonded to a substrate 166. The harder layer 168 have a shaped working surface. The shaped working surface include three depressions 162*a*, 162*b* and 162*c* extending radically outwardly to the cutting edge, a main cutting convex ridge 163 and two non-cutting convex ridges 165 are separated by the three depressions. The depressions 162*a*, 162*b* and 162*c* comprise planar surfaces or facets each at an obtuse angle relative to a central axis 169 of the cutter 160, such that a relative depressed area defining the depressions is formed the convex ridges 163 and 165. A varied geometry chamfer 164 is circumferentially around the intersection of the shaped working surface and a side surface. As can be seen from FIG. 4, the cutter 160 is not axially symmetrical.

FIG. 5 is a cross-sectional view of a portion of a drill bit drills the formation 410 with conventional plane cutter 5. Two plane cutters 5 are separately secured into two pockets 422 of a blade 4 at different position. the blade 4 may comprise a blade profile 420 defined by a starting position, curvature radii and/or angular length, a bit depth and a bit diameter. Each of the two plane cutters 5 has a longitudinal axis 510. The two longitudinal axis 510 have different orientations relative to the profile 420, the two plane cutters 5 have different back rake angle $\alpha$, As can be seen from FIG. 4, the back rake angle $\alpha$ is determined by the blade profile 420, the position of the plane cutter 5 on the blade 4 and orientations of the longitudinal axis 510 of the plane cutter 5 relative to the profile 420. During the assembly process of securing the plane cutter 5 into the pocket 422, the plane cutter 5 may rotate around the longitudinal axis 510 in the pocket 422. Because the cutter 5 is axially symmetrical, regardless of rotation of the plane cutter 5 in the pocket 422, once the blade profile 420, the position of the plane cutter 5 on the blade 4 and orientations of the longitudinal axis 510 of the plane cutter 5 relative to the profile 420 are determined, the back rake angle $\alpha$ of the cutter 5 will not change. But when a shaped cutter such as the cutter 160 in FIG. 4, is assembled into the pocket, although the blade profile 420, the position of the plane cutter 160 on the blade 4 and orientations of the longitudinal axis 169 of the plane cutter 160 relative to the profile 420 can be determined, because the cutter 160 is not axially symmetrical, the back rake angle $\alpha$ of the cutter 160 will change if the shaped cutter 160 rotate in the pocket 422. Therefore, during the assembly process of a bit with shaped cutter, a predetermined back rake angle $\alpha$ may not be acquired because of the rotation of the shaped cutter in the pocket.

Since the back rake angle $\alpha$ is highly dependent upon the orientation of the rotation of a shaped cutter in a pocket of a drill bit, it would be advantageous to provide an alignment structure to help the orientation of the rotation of a shaped cutter in the drill bit.

SUMMARY

In one aspect, the present disclosure is directed to a drill bit for cutting formation. The drill bit comprises a bit body, a plurality of cutters, a plurality of blades with pockets to accommodate the cutters respectively. each of the plurality of cutters has at least one alignment structure to align with at least one counter-alignment structure on each of the pockets to locate the rotary orientation between each of the plurality of cutters and each of the corresponding pockets.

In some embodiments, the cutters are PDC shaped cutters, wherein the shaped cutters are axially asymmetrical. each of blade profile of the plurality of blades, a position and orientation of each of the pockets relative to the blade profile and the rotary orientation of each of the shaped cutter relative to the accommodating pocket are determined such that each of the shaped cutters has a desired orientation of cutting face with respect to the earth formations.

In some embodiments, the alignment structure is a protrusion at the bottom of a substrate of the cutter. In some embodiments, the protrusion is formed integrally with the substrate. In some embodiments, the protrusion is formed by cutting the bottom of the substrate.

In some embodiments, the alignment structure is a depression at the bottom of a substrate of the cutter. In some embodiments, the depression is formed integrally with the substrate. In some embodiments, the depression is formed by cutting the bottom of the substrate. In some embodiments, the alignment structure 412 is a slot.

In an embodiment, the at least one alignment structure aligns with a preferred cutting point on the cutting edge.

In some embodiments, one of the alignment structures aligns with one cutter ridge of the cutter. In an embodiment, the number of the at least one alignment structure is three and the three alignment structures are distributed asymmetrically along the circumference of the bottom of the substrate of the cutter, and further the three alignment structures are 180 degrees apart of a cutting ridge of the cutter.

In some embodiments, the alignment structure is a protrusion at the bottom of a substrate of the cutter. In some embodiments, the protrusion is formed integrally with the substrate. In some embodiments, the protrusion is formed by cutting the bottom of the substrate.

In some embodiments, the counter alignment structure is a depression at the bottom of a substrate of the cutter. In some embodiments, the depression is formed integrally with the substrate. In some embodiments, the depression is formed by cutting the bottom of the substrate. In some embodiments, the counter alignment structure 412 is a slot.

In another aspect, the present disclosure is directed to a method to arrange a shaped cutter to a drill bit, comprises configuring a bit body coupled to a plurality of blades; configuring a shaped cutter which is axially asymmetrical; determining a desired orientation of cutting face of the shaped cutter with respect to a formation based on the performance of the cutter; determining a blade profile of the blade, the position and orientation of a pocket relative to the blade profile and rotary orientation of the shaped cutter relative to the pocked; cutting at least one counter alignment structure on the bottom of the pocket, fabricating corresponding alignment structure on the bottom of the shaped cutter, such that the shaped cutter has a determined rotary orientation relative to the pockets when the slots fit the alignment structures. the performance of the cutter is weight on bit (WOB) or ROP. In some embodiments, fabricating the shaped cutter is to cut the bottom of the substrate using laser cut or electrical discharge machining (EDM).

The foregoing has outlined rather broadly the features of the present disclosure in order that the detailed description that follows may be better understood. Additional features and advantages of the disclosure will be described hereinafter, which form the subject of the claims.

BRIEF DESCRIPTION OF THE DRAWINGS

In order that the manner in which the above-recited and other enhancements and objects of the disclosure are obtained, a more particular description of the disclosure briefly described above will be rendered by reference to specific embodiments thereof which are illustrated in the appended drawings. Understanding that these drawings depict only typical embodiments of the disclosure and are therefore not to be considered limiting of its scope, the disclosure will be described with additional specificity and detail through the use of the accompanying drawings in which.

DETAILED DESCRIPTION

The particulars shown herein are by way of example and for purposes of illustrative discussion of the preferred embodiments of the present disclosure only and are presented in the cause of providing what is believed to be the most useful and readily understood description of the principles and conceptual aspects of various embodiments of the disclosure. In this regard, no attempt is made to show structural details of the disclosure in more detail than is necessary for the fundamental understanding of the disclosure, the description taken with the drawings making apparent to those skilled in the art how the several forms of the disclosure may be embodied in practice.

The following definitions and explanations are meant and intended to be controlling in any future construction unless clearly and unambiguously modified in the following examples or when application of the meaning renders any construction meaningless or essentially meaningless. In cases where the construction of the term would render it meaningless or essentially meaningless, the definition should be taken from Webster's Dictionary 3$^{rd}$ Edition.

The present disclosure relates to shaped cutters that provide advantages when compared to prior art cutters. In particular, embodiments of the present disclosure relate to shaped cutters that have alignment structure in order to improve cutter performance. As a result of the alignment structure, embodiments of the present invention may provide desired orientation of cutting face with respect to the formation when compared with prior art cutters.

Embodiments of the present disclosure relate to cutters having a substrate or support stud, which in some embodiments may be made of cemented carbide, for example tungsten carbide, and an ultra-hard cutting portion or "table" made of a polycrystalline diamond material or a polycrystal line boron nitride material deposited onto or otherwise bonded to the substrate at an interface surface.

Figure 1:
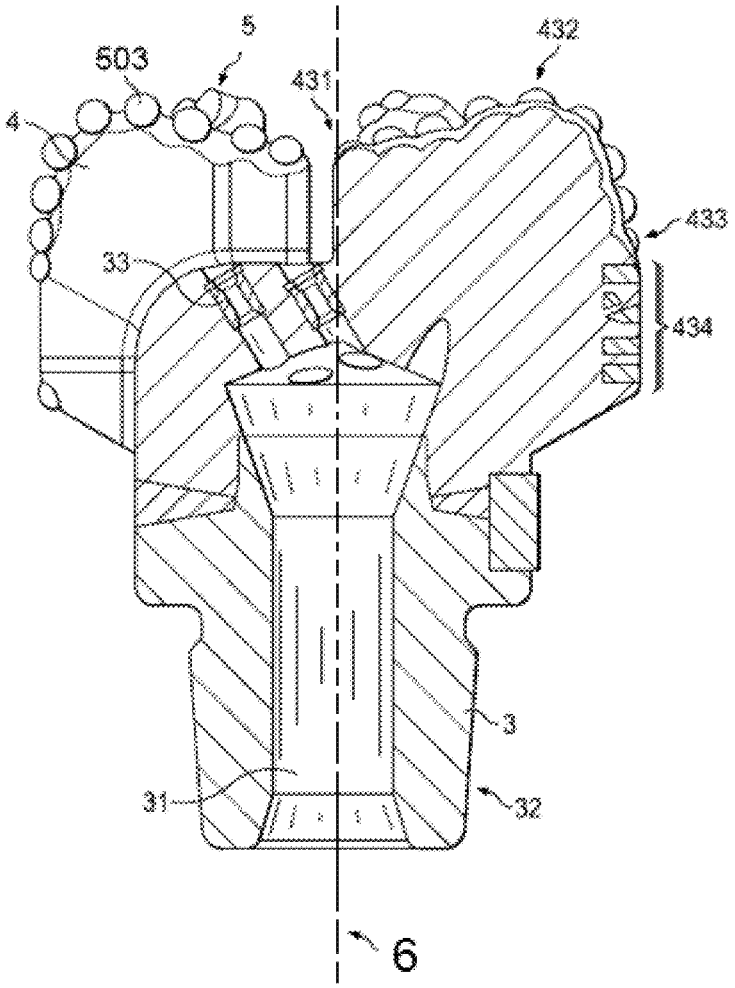
FIG. 1 is a sectional view of a prior art drill bit.
Figure 2:
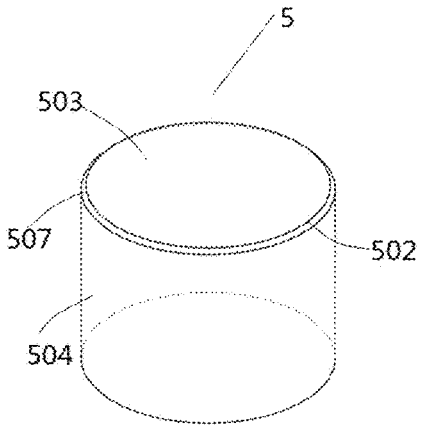
Fig. 2 Prior art
FIG. 2 is a perspective view of a prior art cutter with plane working surface.
Figure 3:
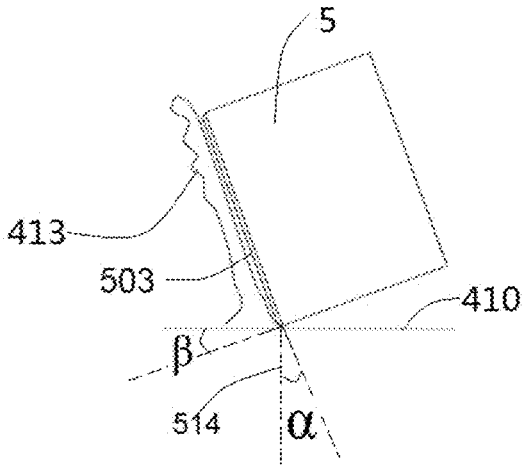
FIG. 3 is a schematic view of a prior art cutter with plane working surface engaged with a formation to illustrate back rake angle.
Figure 4:
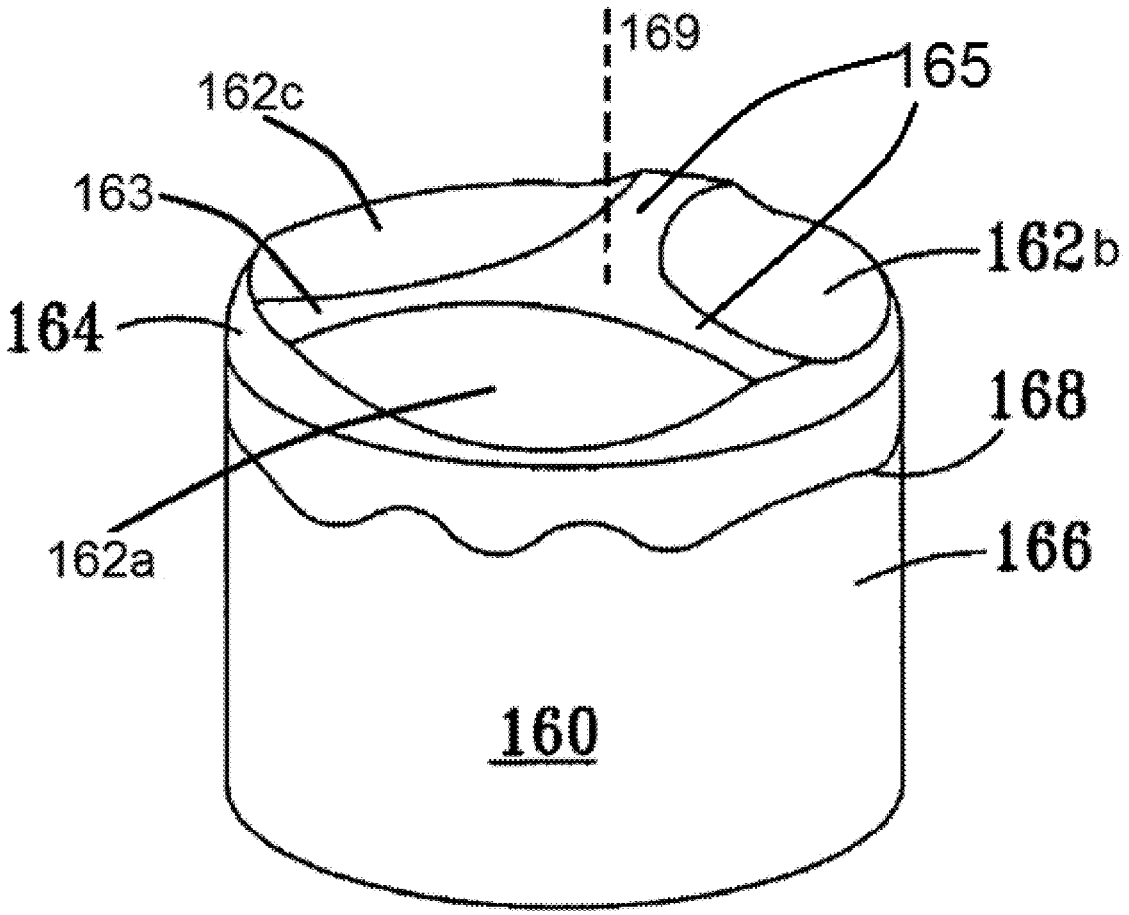
FIG. 4 is a perspective view of a prior art shaped cutter.
Figure 5:
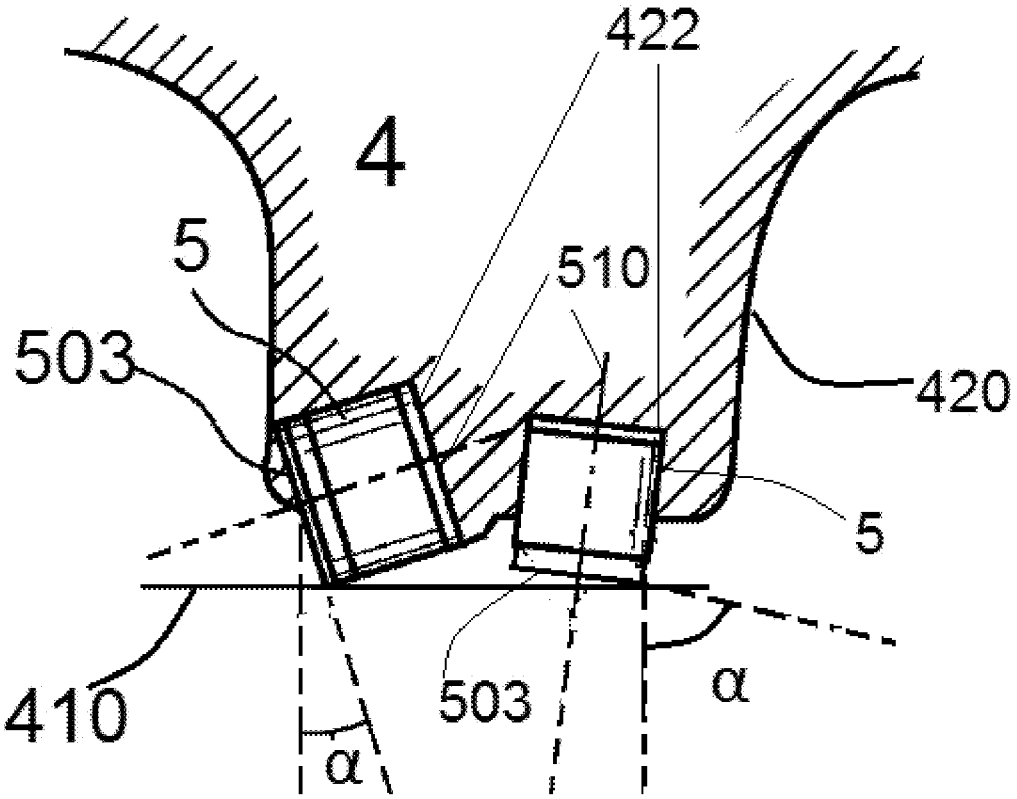
FIG. 5 is a partial sectional view of a prior art cutter with plane working surface engaged with a formation in a cutting operation.
Figure 6:
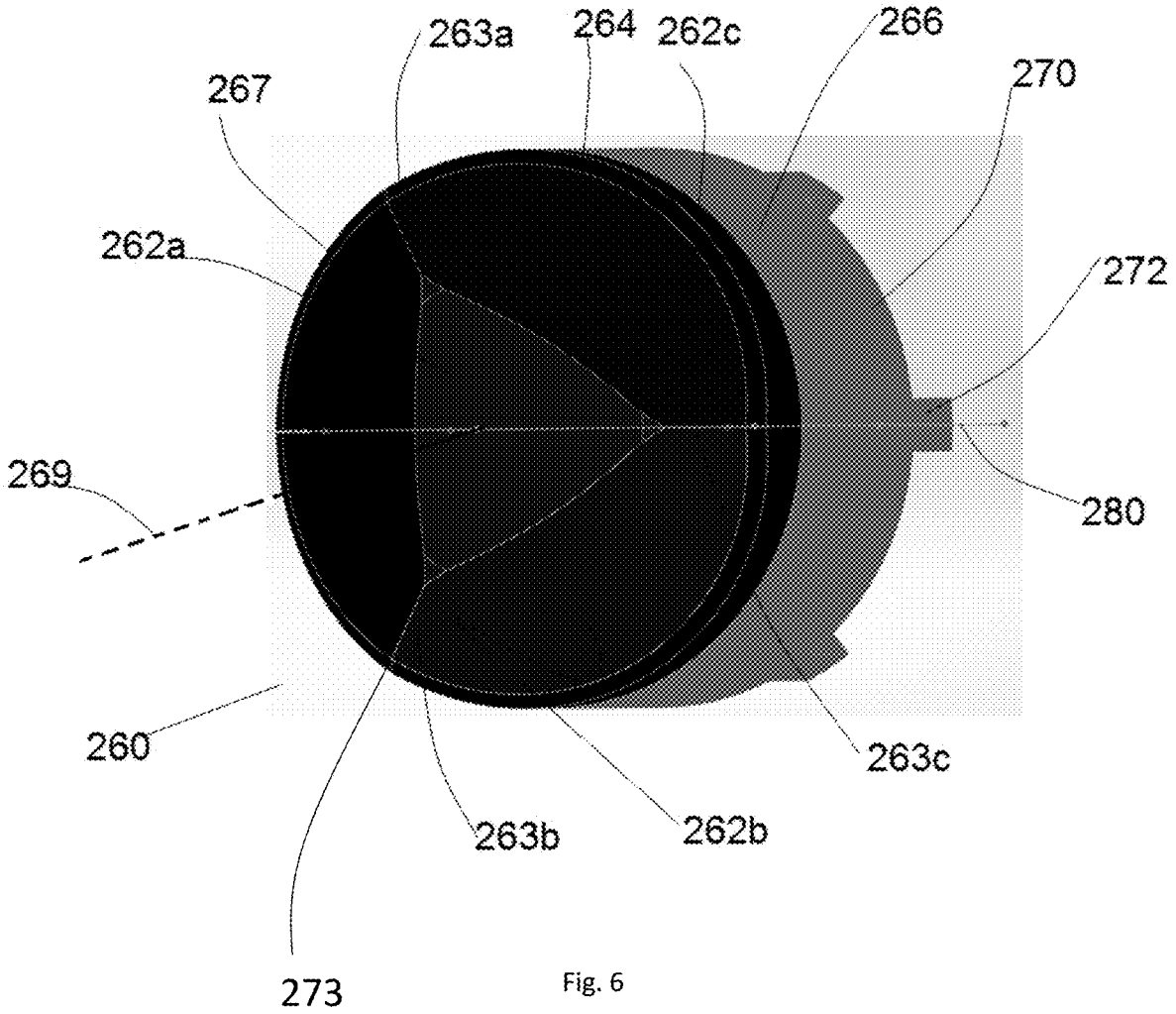
FIG. 6 is a perspective view of a shaped cutter in accordance with an embodiment of the present disclosure.

FIG. 6 illustrates an embodiment of a shaped cutter 260 of the present disclosure. The shaped cutter has a cylindrical cemented carbide substrate 266 and a cutting portion 267. The substrate has a central axis 269 and a generally cylindrical side surface 270. Cutting portion include a shaped working surface. The shaped working surface include three bevels 262*a*, 262*b* and 262*c* extending radically outwardly to the cutting edge, three ridges 263*a*, 263*b*, 263*c* are separated by the three bevels. Three ridges meet the chamfer and form preferred cutting points 273. The bevels comprise planar surfaces or facets each at an obtuse angle relative to a central axis 269 of the cutter, such that three protrude areas are formed the ridges. A chamfer, indicated by reference numeral 264 in FIG. 6, is typically formed on a portion of the outer edge of the cutting portion of shaped cutter. Chamfers generally comprise an angled section, conventionally at a 45° angle to the cutting face of cutting portion, on a portion of the front outer radius of the cutting portion. The chamfers are added to the cutter to reduce localized stresses on the cutting portion 267 when a cutter is first cutting formation material.

The process for making a cutter may employ a body of cemented tungsten carbide as the substrate where the tungsten carbide particles are cemented together with cobalt. The carbide body is placed adjacent to a layer of ultra-hard material particles Such as diamond or cubic boron nitride particles and the combination is subjected to high temperature at a pressure where the ultrahard material particles are thermodynamically stable. This results in recrystallization and formation of a polycrystalline ultra-hard material layer, Such as a polycrystalline diamond or polycrystalline cubic boron nitride layer, directly onto the upper surface of the cemented tungsten carbide substrate 266.

Figure 7:
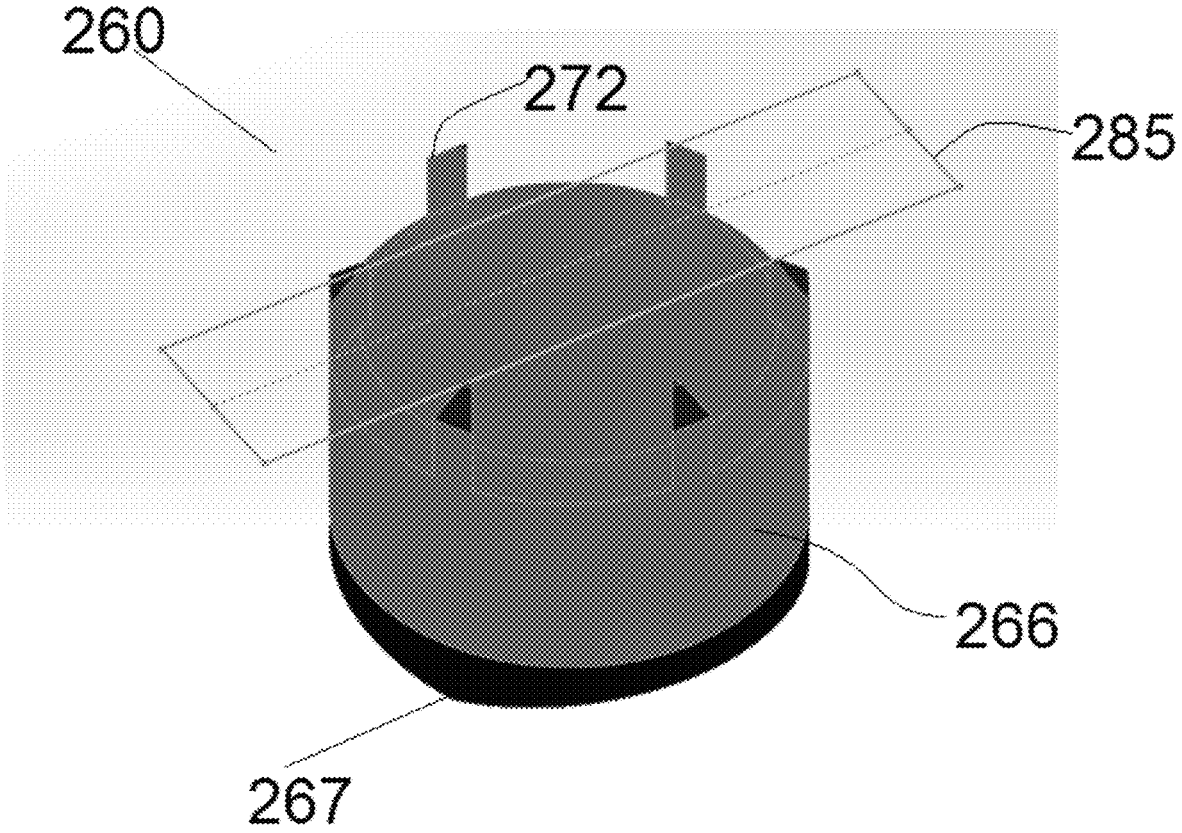
FIG. 7 is a perspective view of a shaped cutter in FIG. 6 with the bottom upward.

As can be seen from FIG. 6, the cutter is axially asymmetrical. In order to control the rotation of the cutter in a pocket, the cutter provides at least one alignment structure 272 at the bottom end of the substrate 266. In some embodiments, the alignment structure 272 can be a protrusion at the bottom of the substrate 266. Referring to FIG. 7, in one embodiment, the alignment structure 272 can be a protrusion along the outer edge of the substrate 266 and be formed integrally within the substrate 266. The alignment structure 272 can be fabricated to cut the bottom of the substrate 266 using laser cut or electrical discharge machining (EDM) cuts to create protrusions. The alignment structure 272 can be located at any place at the bottom of the substrate 266 except the center of the substrate 266. In one embodiment, the alignment structure 272 aligns at least with one cutter ridge. Referring to FIG. 6, a line 280 coincide with a ridge 263*c* and align the center of the alignment structure 272.

EDM is a kind of method to process the size of materials which employs the corrosion phenomena produced by spark discharge. In a low voltage range, EDM performs spark discharge in liquid medium. EDM is a self-excited discharge, which is characterized as follows: before discharge, there is a higher voltage between two electrodes used in spark discharge, when the two electrodes are close, the dielectric between them is broken down, spark discharge will be generated. In the process of the break down, the resistance between the two electrodes abruptly decreases, the voltage between the two electrodes is thus lowered abruptly. Spark channel must be promptly extinguished after maintaining a fleeting time, in order to maintain a "cold pole" feature of the spark discharge, that is, there's not enough time to transmit the thermal energy produced by the channel energy to the depth of the electrode. The channel energy can corrode the electrode partially. When processing diamond composite sheet with EDM, since the residual catalyst metal cobalt produced in the process sintering diamond composite sheet having conductivity, the diamond composite sheet can be used as electrodes in the EDM, and thus can be machined by EDM.

EDM can avoid the error caused by the inability to accurately control the diamond shrinkage during sintering process. EDM technology can effectively control the machining accuracy, and can reduce the damage to the substrate 266 during the machining process. The alignment structure 272 formed by electric spark machining have characteristics of high processing precision, low cost, small damage to the substrate 266 and so on. When processing the alignment structure 272, one can prefabricate plane bottom type substrate 266 at first, and then perform precision machining through EDM. The whole process cost can be reduced, the machining accuracy is satisfied, and the damage to the surface of the diamond composite layer is minimal. There is no need to develop sintering cavity assembly for the diamond composite layer, thus having good flexibility and low-cost. Referring to FIG. 7, a virtual plane 285 is flush with both the bottom of the substrate 266 and the bottom of the alignment structure 272, which means that the alignment structure 272 is fabricated from a plane bottom type substrate.

Figure 8:
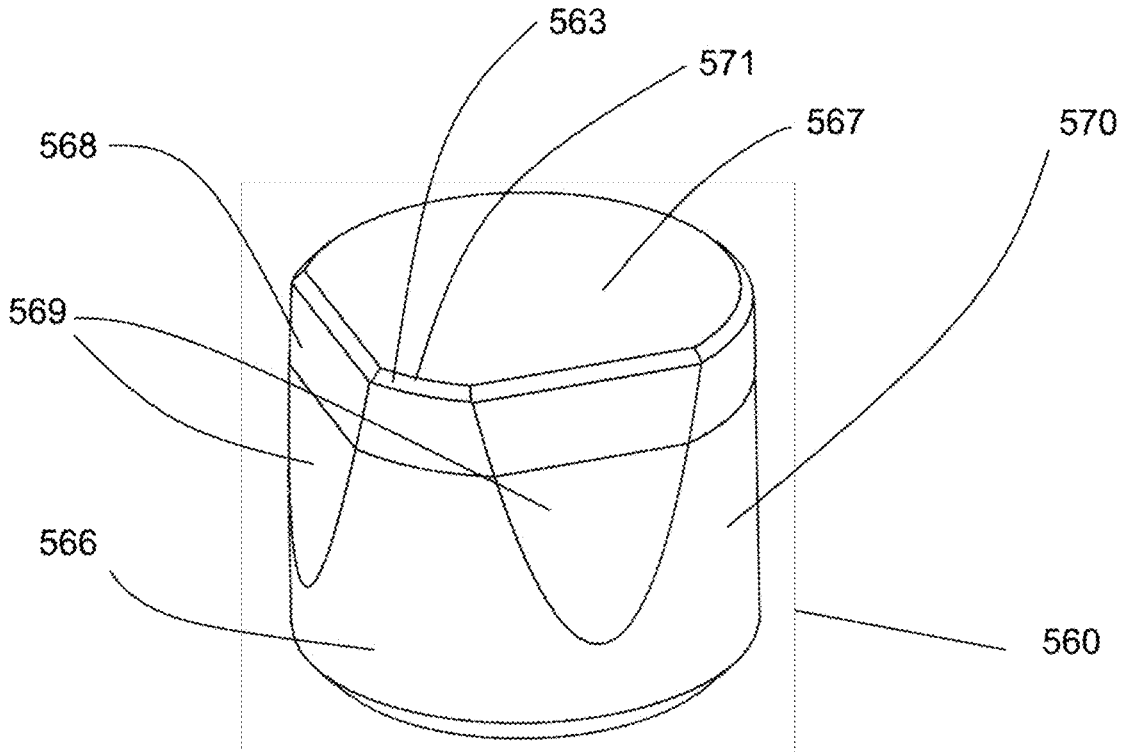
FIG. 8 is a perspective view of an embodiment of a shaped cutter.

FIG. 8 illustrates an embodiment of another type of shaped cutter 560 of the present disclosure. The shaped cutter has a cylindrical cemented carbide substrate 566 and a top ultra-hard layer 568. The substrate has a generally cylindrical side surface 570. The ultra-hard layer includes a shaped working surface 567. The cutter 560 includes two side facets 569. The side facets 569 extend obliquely inward from the substrate 566 to the top surface 567. Thus, they can be regarded as portions of the substrate 566 and ultra-hard layer 568. The side facets 569 are generally planar. A partial circular section 563 is formed between the two side facets 569 and becomes the cutting edge. The center point 571 of the cutting edge becomes the preferred cutting point of this type of shaped cutter.

Figure 9:
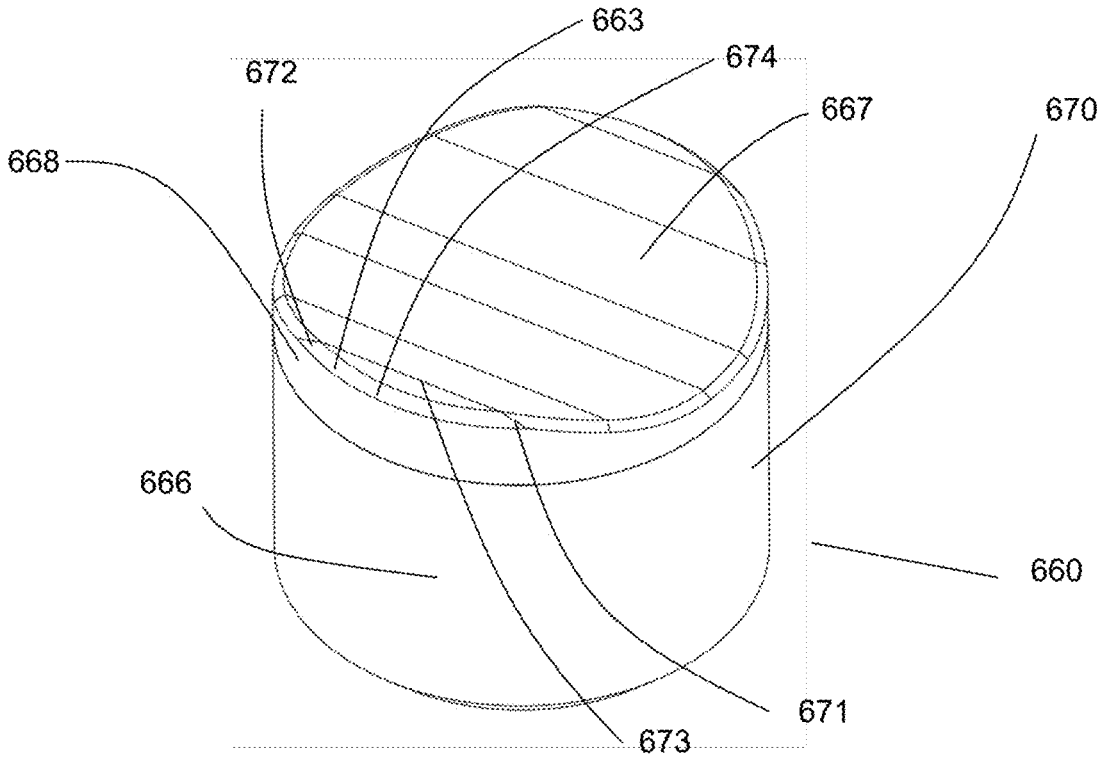
FIG. 9 is s a perspective view of an embodiment of a shaped cutter.

FIG. 9 illustrates an embodiment of yet another type of shaped cutter 660 of the present disclosure. The shaped cutter has a cylindrical cemented carbide substrate 666 and a top ultra-hard layer 668. The substrate has a generally cylindrical side surface 670. The ultra-hard layer includes a concave working surface 667. The edge 673 of the concave surface 667 meets the cylindrical side surface 670 to form cutting edge 663. The center point 674 of the cutting edge 663 is the preferred cutting point for this type of shaped cutter 660.

Figure 10:
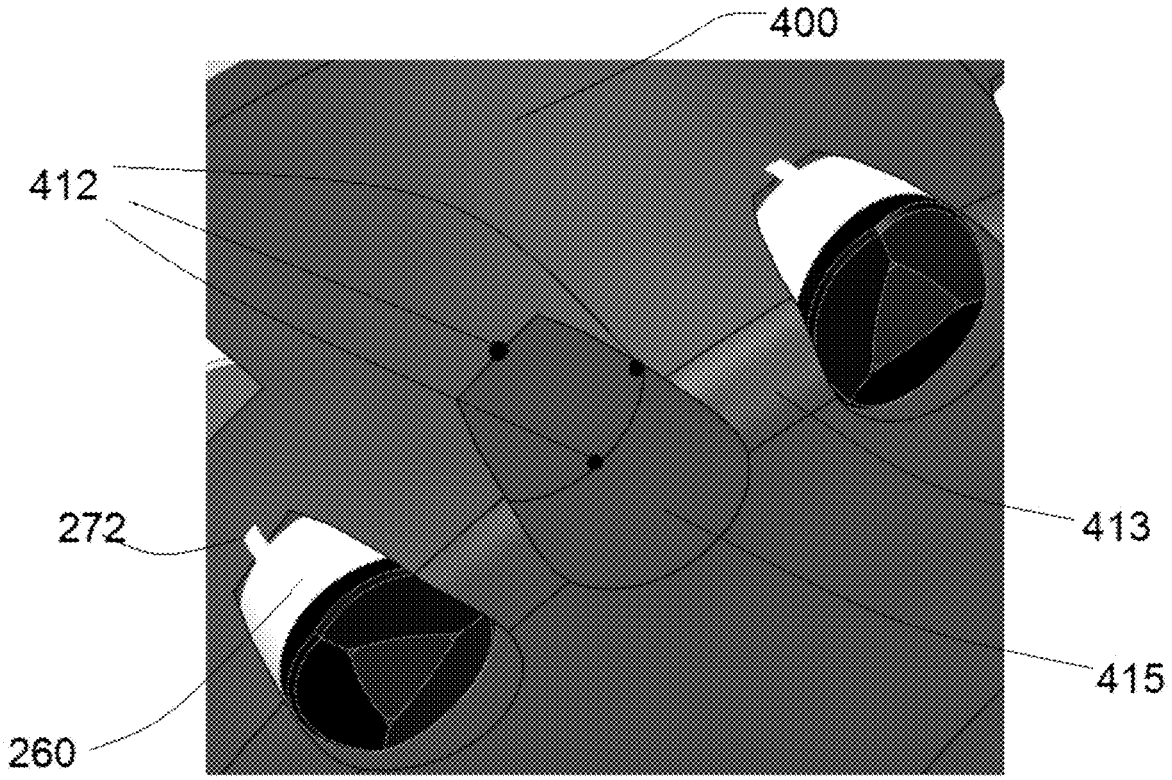
FIG. 10 is a partial sectional view of a drill bit cutter in accordance with an embodiment of the present disclosure.

FIG. 10 illustrates a section of a blade 400 of a bit according to an embodiment of present disclosure. Two shaped cutters 260 described above are separately secured into Two pockets 415 along the profile 413 at different position. The three shaped cutters have different orientations relative to the profile 413, embodiments of the present disclosure may provide desired orientation of cutting face with respect to the formation. The desired orientation of the cutting face can be back rake angle, side rake angle, etc. as described in U.S. Pat. No. 7,441,612 to Bala, which is incorporated herein by reference.

The blade profile 413, the position and orientation of the pockets 415 relative to the blade 400 and orientations of the shaped cutter 260 relative to the pockets 415 can determine the orientation of cutting face with respect to the formation. As described above, because the cutter 260 is not axially symmetrical, the orientation of cutting face with respect to the formation will varied by rotating the shaped cutter 260 in the pockets 415 even if the position and orientation of the pockets 415 relative to the blade 400 is determined. In order to determine the orientation of cutting face with respect to the formation, at least one counter alignment structure 412 is provided on the bottom of the pocket to fit at least an alignment structure 272 of the shaped cutter 260 to align the shaped cutter 260 such that the shaped cutter 260 has a desired orientation of cutting face with respect to the formation. In some embodiments, the counter alignment structure 412 is a depression at the bottom of a substrate of the cutter and the depression is formed integrally with the substrate. In some embodiments, the depression is formed by cutting the bottom of the substrate. In an embodiment, the counter alignment structure 412 is a slot.

The number of the counter alignment structures 412 in the pocket can be arbitrary and equals to the number of alignment structures 272 on the shaped cutter 260. The slots are distributed asymmetrically along the circumference of the bottom of the pockets 415, and alignment structures 272 are located on the corresponding position at the bottom of the shaped cutter 260 such that the shaped cutter 260 has a determined rotary orientation relative to the pockets 415 when counter alignment structures 412 fit the alignment structures 272. In one embodiment, referring to FIG. 10, the pockets 415 provides three slots 180 degrees apart of the cutting ridge.

The bit body in this embodiment can be a matrix body bit. Matrix bits include a mass of metal powder, such as tungsten carbide particles, infiltrated with a molten, subsequently hardened binder, such as a copper based alloy. Optionally, the bit may also be a steel or other bit type, such as a sintered metal carbide. Steel bits are generally made from a forging or billet, then machined to a final shape. The disclosure is not limited by the type of bit body employed for implementation of any embodiment thereof.

In some other embodiments, the present disclosure provides a process to arrange a shaped cutter to a drill bit. The process includes configuring a bit body coupled to a plurality of blades; configuring a shaped cutter which is axially asymmetrical; based on the performance of the bit, determining the desired orientation of cutting face with respect to the formation of the shaped cutter; this step can be implemented by methods presented in U.S. Pat. No. 7,693,695 to Sujian, which is incorporated herein by reference.

And then, according to the desired orientation of cutting face with respect to the formation of the shaped cutter, a blade profile of the blade, the position and orientation of a pocket relative to the blade profile and rotary orientation of the shaped cutter relative to the pocked is determined.

Cutting at least one counter-alignment structure on the bottom of the pocket, fabricating corresponding alignment structure on the bottom of the shaped cutter, such that the shaped cutter has a determined rotary orientation relative to the pockets when the counter-alignment structures fit the alignment structures.

In some embodiments, the performance of the bit is the weight on bit (WOB) or ROP. The alignment structure can be fabricated to cut the bottom of the substrate using laser cut or electrical discharge machining (EDM). The alignment structure can be a protrusion at the bottom of the substrate. The number of the slots in the pocket can be arbitrary, and equals to the number of alignment structures on the shaped cutter. The slots are distributed asymmetrically aterie along the circumference of the bottom of the pockets. In one embodiment, the pocket provides three slots 180 degrees apart of the cutting ridge. In one embodiment, the alignment structure is aligned a ridge of the shaped cutter.

All of the compositions and methods disclosed and claimed herein can be made and executed without undue experimentation in light of the present disclosure. While the compositions and methods of this disclosure have been described in terms of preferred embodiments, it will be apparent to those of skill in the art that variations may be applied to the compositions and methods and in the steps or in the sequence of steps of the methods described herein without departing from the concept, spirit and scope of the disclosure. More specifically, it will be apparent that certain agents which are related may be substituted for the agents described herein while the same or similar results would be achieved. All such similar substitutes and modifications apparent to those skilled in the art are deemed to be within the spirit, scope and concept of the disclosure as defined by the appended claims.

What is claimed is:

1. A drill bit for cutting earth formations, comprising
a bit body;
a plurality of cutters having cutter ridges;
a plurality of blades with pockets to accommodate the plurality of cutters respectively;
wherein each of the plurality of cutters has at least one alignment structure to align with at least one counter alignment structure on each of the pockets to locate the rotary orientation between each of the plurality of cutters and each of the corresponding pockets; and
wherein one of the at least one alignment structure aligns with one of the cutter ridges, wherein a line parallel to the cutter longitudinal axis coincides with the one of the cutter ridges and passes through the one of the at least one alignment structure.

2. The drill bit of claim 1, wherein the cutters are PDC cutters.

3. The drill bit of claim 2, wherein the cutters are shaped cutters.

4. The drill bit of claim 3, wherein the shaped cutters are axially asymmetrical.

5. The drill bit of claim 4, wherein each blade profile of the plurality of blades, a position and orientation of each of the pockets relative to the blade profile and the rotary orientation of each of the shaped cutter relative to the accommodating pocket are determined such that each of the shaped cutters has a desired orientation of cutting face with respect to the earth formations.

6. The drill bit of claim 1, wherein the alignment structure is a protrusion at the bottom of a substrate of the cutter.

7. The drill bit of claim 6, wherein the protrusion is formed integrally with the substrate.

8. The drill bit of claim 7, wherein the protrusion is formed by cutting the bottom of the substrate.

9. The drill bit of claim 1, wherein the alignment structure is a depression at the bottom of a substrate of the cutter.

10. The drill bit of claim 9, wherein the depression is formed integrally with the substrate.

11. The drill bit of claim 10, wherein the depression is formed by cutting the bottom of the substrate.

12. The drill bit of claim 1, wherein the number of the at least one alignment structure is three.

13. The drill bit of claim 12, wherein the three alignment structures are distributed asymmetrically along the circumference of the bottom of the substrate of the cutter.

14. A method to arrange a shaped cutter to a drill bit, comprising:
configuring a bit body coupled to a plurality of blades;
configuring a shaped cutter having at least one cutter ridge;
determining a desired orientation of cutting face of the shaped cutter with respect to a formation based on the performance of the cutter;
determining a blade profile of the blade, the position and orientation of a pocket relative to the blade profile and rotary orientation of the shaped cutter relative to the pocket;
fabricating at least one alignment structure on the bottom of the shaped cutter, fabricating at least one slot on the bottom of the pocket, such that the shaped cutter has a determined rotary orientation relative to the pocket when the at least one slot fits the at least one alignment structure;
wherein one of the at least one alignment structure aligns with one of the at least one cutter ridge, wherein a line parallel to the cutter longitudinal axis coincides with the one of the cutter ridges and passes through the one of the at least one alignment structure.

15. The method of claim 14, wherein the performance of the cutter is WOB.

16. The method of claim 14, wherein the performance of the cutter is ROP.

17. The method of claim 14, wherein fabricating the at least one alignment structure on the bottom of the shaped cutter is to cut the bottom of the substrate of the shaped cutter using laser cut or electrical discharge machining.

* * * * *